United States Patent [19]

Odagiri et al.

[11] Patent Number: 4,779,248

[45] Date of Patent: Oct. 18, 1988

[54] ELECTRONIC TIMEPIECE

[75] Inventors: Hiroshi Odagiri; Yuichi Inoue; Hiroyuki Masaki, all of Tokyo, Japan

[73] Assignee: Seiko Instruments Inc., Tokyo, Japan

[21] Appl. No.: 35,092

[22] Filed: Apr. 6, 1987

[30] Foreign Application Priority Data

Apr. 8, 1986 [JP] Japan ..... 61-80722

[51] Int. Cl.[4] ..... G04B 17/20

[52] U.S. Cl. ..... 368/202; 331/176

[58] Field of Search ..... 368/155-157, 368/200-202; 331/176, 47, 66, 77

[56] References Cited

U.S. PATENT DOCUMENTS

| | | | |
|---|---|---|---|
| 4,382,692 | 5/1983 | Wiget et al. | 368/157 |
| 4,427,302 | 1/1984 | Watanabe | 368/202 |
| 4,537,515 | 8/1985 | Dinger et al. | 368/202 |

*Primary Examiner*—Vit W. Miska

*Attorney, Agent, or Firm*—Bruce L. Adams; Van C. Wilks

[57] ABSTRACT

A rate displaying oscillator circuit for converting and displaying a rate is provided separately from an oscillator which generates a reference signal so that, even when the period of a logical regulator is extended in order to improve the resolving power of the logical regulation, the average rate of the logical regulator can be measured with a commercially available measuring device.

6 Claims, 5 Drawing Sheets

ELECTRONIC TIMEPIECE

BACKGROUND OF THE INVENTION

1. Field of the Invention

The present invention relates to an electronic timepiece having a function of converting and displaying an average rate obtained by a logical regulation within a short period of time, the logical regulation being carried out in a period longer than a logical regulation period which is generally employed.

2. Description of the Prior Art

The regulation resolving power of temperature-compensated electronic timepieces is required to be an exceedingly small value, that is 4 ms/d or 8 ms/d, in order to realize high precision.

To achieve such resolving power by means of a logical regulator, the operating period of the logical regulator must be 640 seconds or 320 seconds.

However, since the maximum time which can be measured with conventional measuring devices which are obtainable on the market has heretofore been 10 seconds, no regulation which involves a resolving power of 4 ms/d cannot be effected by a logical regulator.

Accordingly, it is conventional practice to adopt, for example, a method wherein the load capacity of an oscillator circuit is switched.

The above-described method in which an oscillator circuit is directly actuated has the disadvantages that oscillating characteristics are undesirably changed to a substantial extent and that it is necessary to additionally carry out an operation of adjusting the amount of regulation when the oscillator circuit is actuated. In addition, since an analog quantity is handled to adjust the amount of regulation, errors are readily generated in adjustment, and it is therefore impossible to effect temperature compensation of high precision.

SUMMARY OF THE INVENTION

To solve the above-described problems, according to the present invention, minute regulation is also carried out by a logical regulator, and a rate converting function and indicating function is provided for indicating an average rate.

It is necessary, in order to obtain a resolving power of 4 ms/d, to carry out a logical regulator operation in a period of 640 seconds ($1/(32768\times640)$). However, the maximum time which can be measured with commercially available measuring devices is 10 seconds as described above.

According to the present invention, a frequency which is 64 times the oscillation frequency of a reference signal, i.e., 32 KHz, is prepared in an oscillator circuit for indicating a rate in order to indicate an average rate of a logical regulation carried out in a period of 640 seconds, and a duration between each pair of adjacent rate measuring pulses is modulated for a time corresponding to a 640-second logical regulation to indicate the average rate.

For instance, to indicate a rate of $-1/(32768\times640)$, rate measuring pulses which are output in a period of 10 seconds are output in such a manner that the rise of each pulse is delayed by a time corresponding to one cycle of an oscillation frequency which is 64 times 32 KHz.

DETAILED DESCRIPTION OF THE PREFERRED EMBODIMENT

One emobodiment of the present invention will be described hereinunder with reference to the drawings.

Figure 1:
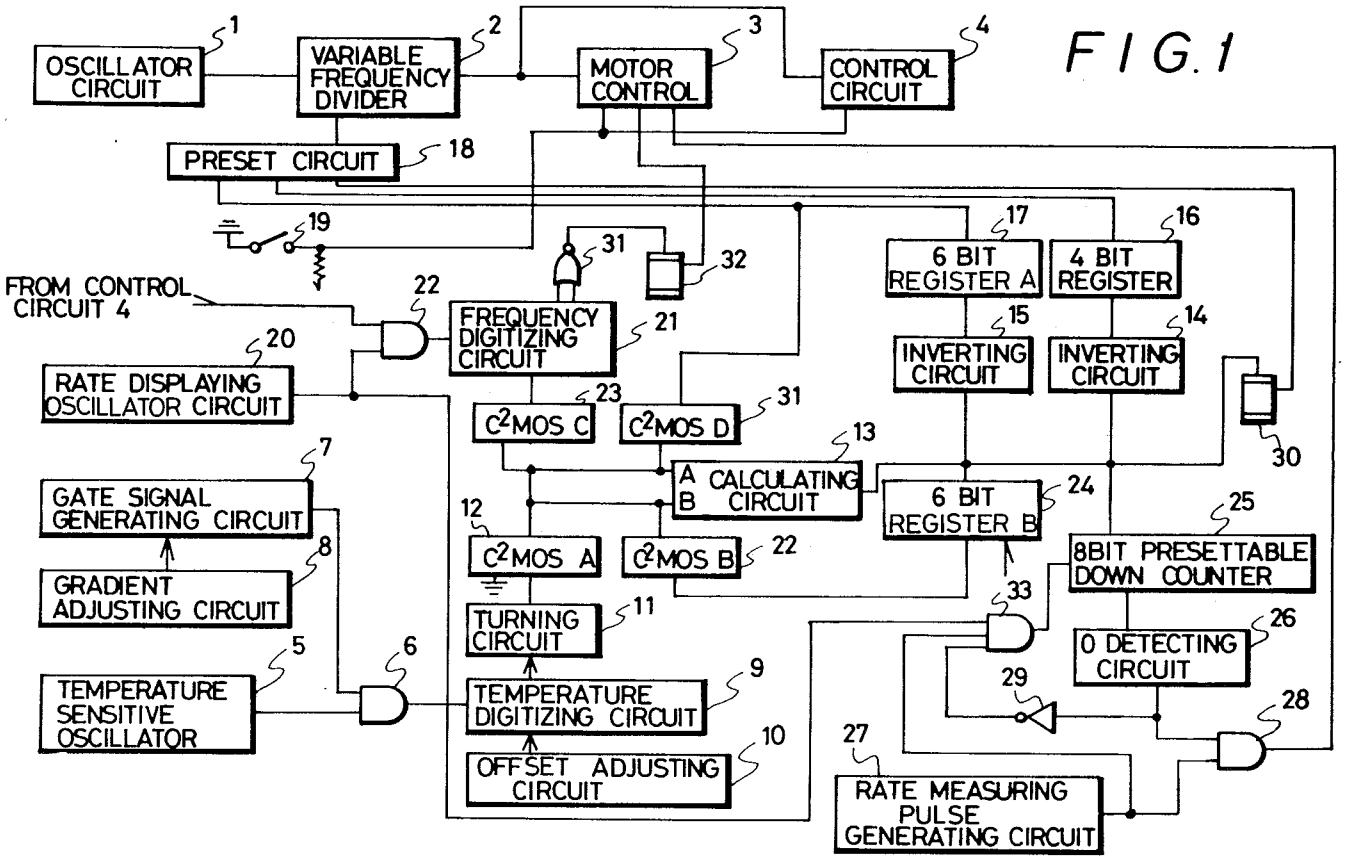
FIG. 1 is a block diagram employed to describe the operation of the present invention.

FIG. 1 is a block diagram employed to describe the operation of the present invention.

A reference signal for timekeeping which is oscillated by means of an oscillator circuit 1 is frequency-divided with a variable frequency divider 2. The frequency-divided signal is supplied to various circuits. A motor controller 3 drives a stepping motor (not shown), and a control circuit 4 controls various circuits in a time sequential manner.

A temperature-sensitive oscillator 5 is a temperature detecting circuit whose oscillation frequency $f_T$ varies with temperature.

The output terminal of the temperature-sensitive oscillator 5 is connected to a gate circuit 6. A gate signal generating circuit 7 is connected to the other input terminal of the gate circuit 6.

The time duration of a gate signal which is output from the gate signal generating circuit 7 is changed in accordance with a value A output from a gradient adjusting circuit 8. During the period when the output of the gate signal generating circuit 7 is "H", a signal output from the temperature-sensitive oscillator 5 is output from the gate circuit 6 and input to a temperature digitizing counter 9. An initial value for the temperature digitizing counter 9 is set in accordance with a value B output from an offset adjusting circuit 10.

As a result, the numerical data M remaining in the temperature digitizing counter 9 can be represented by the following equation:

$$M=A\times\tau\times f_T+B-2^l\times j$$

where:

$\tau$ is a unit time for a gate signal output from the gate signal generating circuit 7;

l represents the number of bits of the temperature digitizing counter 9;

$f_T$ represents the output frequency of the temperature-sensitive oscillator circuit 5; and j represent the number of times of overflow.

If the temperature digitizing counter 9 has a 10-bit construction, m changes between 0 and 1023.

An operation of making 512, which is a center value of m, coincident with the zero temperature coefficient temperature (hereinafter abbreviated to $T_p$) of a crystal oscillator which constitutes the oscillator circuit 1 is carried out at A and B.

Figure 8:
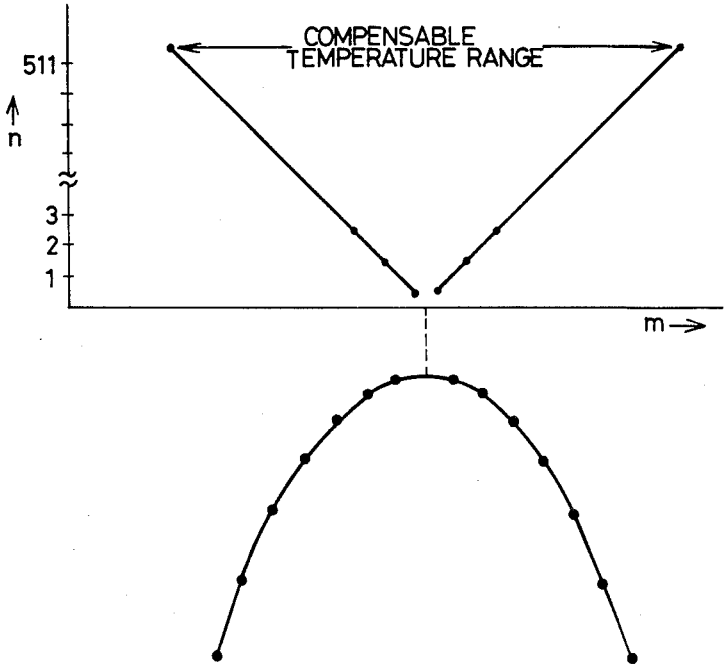
FIG. 8 shows the temperature data $n+0.5$.

In order that m may change symmetrically at the high- and low-temperature sides with respect to $T_p$, the output m of the temperature digitizing counter 9 is inverted in a turning circuit 11 by examining the highest significant bit, thereby preparing temperature data n. When n is prepared by inverting m, 0.5 is added to 9-bit data so that n changes bisymmetrically at the low- and high-temperature sides with respect to $T_p$. This is shown in FIG. 8. The addition of 0.5 is performed with a clocked $C^2$ MOS A 12 which delivers the 9-bit output from the turning circuit 11 to an input bus of a calculating circuit 13.

The temperature data n represents the amount by which a actual temperature is offset from $T_p$ of the crystal oscillator of the oscillator circuit 1. Therefore, temperature compensation data R can be calculated by squaring n and multiplying the squared n by a certain coefficient K.

The calculating circuit 13 is supplied with a 10-bit input data and delivers a 10-bit output data, the circuit 13 being able to perform both addition and multiplication.

The coefficient K is a value which is determined by the resolving power of regulation, the secondary temperature coefficient of the crystal oscillator and the temperature coefficient of the temperature-sensitive oscillator, the coefficient K being 1/256 in the case of this embodiment. Subtraction is effected by shifting bits, that is by, selecting bits which are to be employed.

Figure 2:
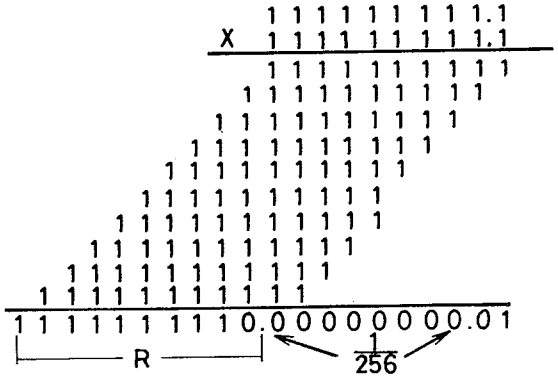
FIG. 2 shows an example of the calculation of $R=K(n+0.5)^2$.

FIG. 2 shows an example of calculation of the temperature compensation data $R=K\ (n\ n+0.5)^2$.

Ten bits as the result of calculation are output from the calculating circuit 13. This calculation result is data representing the amount by which a particular rate is offset from the rate at $T_p$.

The logical regulation in this embodiment is to retard the rate. Therefore, high-order 4 bits in the calculation result are inverted by an inverting circuit 14, while low-order 6 bits are inverted in an inverting circuit 15, and the high-order 4 bit data is latched by a 4-bit register 16, while the low-order 6 bit data is latched by a 6-bit register A 17.

Figure 3:
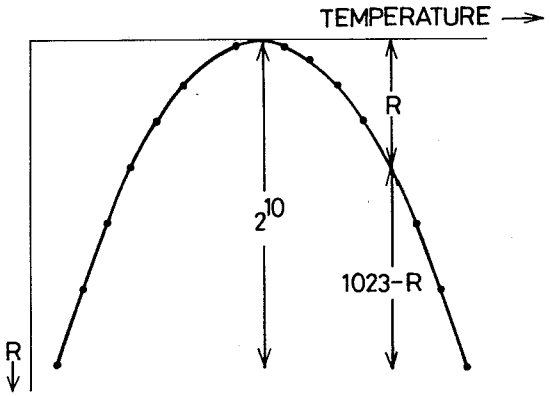
FIG. 3 shows the meaning of the inversion of the calculation result.

The meaning of this inversion is shown in FIG. 3.

The temperature compensation data items which are respectively latched by the 4-bit register 16 and the 6-bit register A 17 are input to a preset circuit 18 which sets a frequency-division ratio for the variable frequency divider circuit 2.

The high-order temperature compensation data which is latched by the 4-bit register 16 changes the frequency-division ratio for the variable frequency-divider circuit 2 in a period of 10 seconds in response to the operation of the control circuit 4.

The low-order data which is latched by the 6-bit register 17 changes the frequency-division ratio for the variable frequency divider circuit 2 in a period of 640 seconds.

As a result, the data latched by the 4-bit register 16 is utilized for regulation with a resolving power of $1/(32768\times 10)$, while the data latched by the 6-bit register A 17 is utilized for regulation with a resolving power of $1/(32768\times 640)$.

Normally, temperature compensation is carried out by the above-described operation. However, in this normal operation state, the logical regulation is carried out in a period of 640 seconds; therefore, an average rate cannot be measured with a commercially available measuring device.

Accordingly, the present invention is provided with a rate measuring mode which enables an average rate to be measured in a period of 10 seconds by turning on an external operation switch 19. When the external operation switch 19 is turned on, the motor controller 3 inhibits the output of normal pulses for driving a stepping motor and activates a rate measuring pulse generating circuit 27 to output rate measuring pulses $P_H$ in a period of 10 seconds.

The control circuit 4 controls various circuits for modulating the pulse spacing of rate measuring pulses in time sequence and in conjunction with the above-described normal operation.

The logical regulation carried out in a period of 10 seconds on the basis of the data latched by the 4-bit register 16 is also performed in the rate measuring mode.

The logical regulation carried out in a period of 640 seconds on the basis of the data latched by the 6-bit register A 17 is inhibited in the rate measuring mode, and an amount of regulation attained by the 640-second logical regulation is indicated using a signal output from a rate indicating oscillator circuit 20.

First, the oscillation frequency of the rate indicating oscillator circuit 20 is measured with the frequency digitizing counter 21.

The output of the rate indicating oscillator circuit 20 is supplied to gate circuits 22 and 33.

The other input terminal of the gate circuit 22 is supplied with pulses having a time duration of 1/4096 from the control circuit 4.

Within the period of 1/4096, the output frequency of the rate indicating oscillator circuit 20 is input to the frequency digitizing counter 21.

The frequency digitizing counter 21 is a 11-bit binary counter. High-order 10 bits of the output data from the counter 21 are input as measurement data to the input bus A of the calculating circuit 13 through the clocked CMOS 23.

Next, the contents of the 6-bit register A 17 which latches an amount of regulation attained by the 640-second logical regulation and the contents of a 6-bit register B 24 are added together in the calculating circuit 13, and the result of addition is latched by the 6-bit register B 24.

The 6-bit register B 24 is reset when the external operation switch 19 is turned on.

Accordingly, the initial value for the 6-bit register B 24 is 0, and data items concerning the logical regulation carried out in a period of 640 seconds are totaled every time the calculation is carried out.

The sum total of 640-second logical regulation data items will hereinafter be referred to simply as "data S".

Next, data for indicating a rate is calculated on the basis of the data S and the contents of the frequency digitizing counter 21 which represent measurement data from the rate indicating oscillator circuit 20 described above.

Assuming that the oscillation frequency of the rate indicating oscillator circuit 20 is 2097152 Hz which is exactly 64 times the oscillation frequency of the oscillator circuit 1 for easier understanding, the frequency digitizing counter 21 inputs the binary number 256 to the input bus A of the calculating circuit 13.

Figure 4:
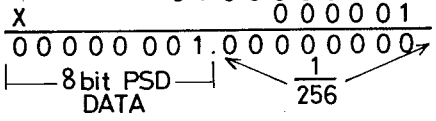
FIG. 4 shows an example of the calculation of rate indicating data.

If the contents of the 6-bit register B 24 latching the data S concerning the 640-second logical regulation represent "1", the calculating circuit 13 calculates $256 \times S/256$ and outputs "1". An example of this calculation is shown in FIG. 4.

With this timing, an 8-bit presettable down counter (hereinafter abbreviated as "8-bit PSD") 25 is set by the output from the calculating circuit 13. When the contents of the 8-bit PSD 25 are not "0", the output from a "0" detecting circuit 26 for detecting the "0" state of the 8-bit PSD 25 changes to "L".

Thereafter, a rate measuring pulse $P_H$ is output to the gate circuits 33 and 28 from the rate measuring pulse generating circuit 27.

When the output from the "0" detecting circuit 26 is "L" and a rate measuring pulse $P_H$ is generated, the 8-bit PSD 25 counts down in response to the output oscillated from the rate indicating oscillator circuit 20.

Since the contents of the 8-bit PSD 25 now represent "1", when the 8-bit PSD 25 counts one shot of the output oscillated from the rate indicating oscillator circuit 20, the contents of the 8-bit PSD 25 change to "0".

As a result, the output from the "0" detecting circuit 26 is "H", and an inverter circuit 29 functions so that the output oscillated from the rate indicating oscillator circuit 20 is blocked by the gate circuit The rate measuring pulse $P_H$, which is blocked by the gate circuit 28 since the output from the "0" detecting circuit 26 is "L", is input to the motor controller 3 in such a manner that the rise of the pulse $P_H$ is delayed by a time corresponding to one cycle of the oscillation output of the rate indicating oscillator circuit 20. The motor controller 3 outputs the rate measuring pulse $P_H$ to the stepping motor as a rate information.

More specifically, an average rate of $-1/32768 \times 640)$ of the 640-second logical regulation is indicated in a period of 10 seconds by delaying the rise of the pulse by a time corresponding to one cycle of a frequency which is 64 times 32768.

Thus, in this embodiment, the 8-bit PSD 25, the "0" detecting circuit 28 and the gate circuits 33, 28 constitute in combination a rate measuring pulse modulating circuit.

A rate measuring pulse $P_H$ which rises when 10 seconds has elapsed after one rate measuring pulse $P_H$ has been output is output after being delayed by a time corresponding to two cycles of the oscillation frequency of the rate indicating oscillator circuit 20 the data S concerning the 640-second logical regulation is 2.

Accordingly, when the 640-second logical regulation data is 1, the rate measuring pulse interval is made longer than the period of normal rate measuring pulses $P_H$, and a subsequent pulse is output after being delayed by a time corresponding to an amount of regulation effected by the 640-second logical regulation, i.e., $-1/(32768 \times 640)$, that is, one cycle of the oscillation output of the rate indicating oscillator circuit 20 in the above-described example.

If this operation is continued, the size of the data S concerning the 640-second logical regulation exceeds the size of the 6-bit register B 24 for latching the data S.

In this embodiment, since the 640-second logical regulation and the 10-second logical regulation are employed in combination, when the data S concerning the 640-second logical regulation reaches 64, it becomes equal to the amount of regulation made by the 10-second logical regulation $(1/(32768 \times 10) = 64/(32768 \times 640))$. Therefore, at the timing when the data S is calculated, the 7th bit on the output bus of the calculating circuit 13 is latched by a latch 30, and when the output of the latch 30 is "H", the 10-second logical regulation is activated for $1/(32768 \times 10)$ by the preset circuit 18. When the oscillation frequency of the rate indicating oscillator circuit 20 is 64 or less times the oscillation frequency of the oscillator circuit 1 due to, for example, decrease in voltage, it becomes impossible to indicate a rate by means of rate measuring pulses $P_H$ having a period of 10 seconds.

Therefore, when the oscillation frequency of the rate indicating oscillator circuit 20 is measured with the frequency digitizing counter 21, the fact that the oscillation frequency of the rate indicating oscillator circuit 20 is 64 or less times that of the oscillator circuit 1 is detected by a gate circuit 31, and this information is latched by a latch 32.

When the output of the latch 32 is "H", the indication of a rate cannot be effected by means of the rate measuring pulses $P_H$. In such a case, the motor control circuit 3 indicates the fact that the lifetime of the battery has expired so that rate measuring pulses $P_H$ are not output.

The above is a description of the arrangement shown in FIG. 1 which is a block diagram of one embodiment of the present invention.

The following is a more detailed description of the operation of the embodiment in the rate measuring mode, which is characteristic of the present invention.

Measurement of the oscillation frequency of the rate indicating oscillator circuit 20 will first be explained.

If it were possible to set the oscillation frequency of the rate indicating oscillator circuit 20 so as to be precisely times the oscillation frequency of the oscillator circuit 1, it would be unnecessary to measure the oscillation frequency of the rate indicating oscillator circuit 20.

In practice, however, there are variations in the oscillation frequency of the oscillator circuit 1, and the rate indicating oscillator circuit 20 cannot employ a crystal oscillator which can be expected to oscillate precisely due to the limited space for the electronic timepiece and there are therefore considerable variations in the oscillation frequency of the rate indicating oscillator circuit 20. Accordingly, it is necessary to measure the oscillation frequency of the rate measuring oscillator circuit 20.

In this embodiment, the oscillation frequency of the rate indicating oscillator circuit 20 is allowed to range from 2097152 Hz to 8388607 Hz.

Since the input bus of the calculating circuit 13 has a 10-bit construction, the oscillation frequency of the rate indicating oscillator circuit 20 needs to be converted into binary numbers 0 to 1023.

The gate circuit 22 which controls the input of a frequency signal to the frequency digitizing counter 21 is supplied with pulses having a time duration of 1/4096 from the control circuit 4. As a result, the contents of the frequency digitizing counter 21 represent the following numbers in accordance with the oscillation frequency of the rate indicating oscillator circuit 20: when the frequency is 2097152 Hz, $2097152/4096 = 512$; and when the frequency is 8388607 Hz, $8388607/4096 = 2048$. Since the oscillation frequency exceeds $2^{10}=1024$ at its upper limit, the frequency digitizing counter 21 has an 11-bit construction, and high-order 10 bits thereof are used as measurement data. In consequence, measurement data represent as follows: 256 in the case of 2.09 MHz; and 1023 in the case of 8.38 MHz.

The lower limit of the allowable frequency range, that is, 2097152 Hz, is determined by the regulation period of the 640-second logical regulation according to this embodiment. When the oscillation frequency of the rate indicating oscillator circuit 20 is lower than the lower-limit value, it is impossible to indicate a rate in a period of 10 seconds. For this reason, the gate circuit 31 is provided to detect the fact that the oscillation frequency of the rate indicating oscillator circuit 20 is lower than the lower-limit value. The gate circuit 31 is a 2-input NOR gate which is connected to the 10th and 11th bit terminals of the frequency digitizing counter 21. When the oscillation frequency of the rate indicating oscillator circuit 20 is 2097151 Hz, which is lower than the lower-limit value, both the 10th and 11th bits of the frequency digitizing counter 21 are "L", and the output of the gate circuit 31 is therefore "H".

This "H" signal is latched by a latch 32 in response to a clock signal delivered from the control circuit 4. When the signal output from the latch 32 is "H", the motor control 3 stops the output of rate measuring pulses $P_H$.

The reason why the 8-bit presettable down counter 25 has an 8-bit construction and also errors which may be generated in indication of a rate will next be explained.

Data which is to be set in the 8-bit PSD 25 is calculated on the basis of the data S concerning the 640-second logical regulation which is latched by the 6-bit register B 24 and 10-bit data output from the frequency digitizing counter 21.

Figure 5:
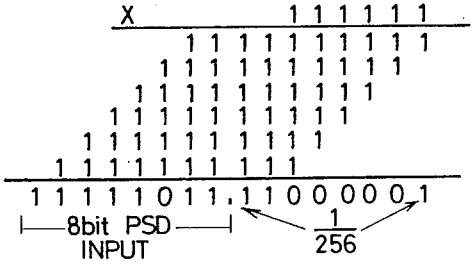
FIG. 5 shows an example of calculation of rate indicating data in the case where both the data S and the frequency digitizing counter data are maximum.

FIG. 5 shows an example of the calculation performed when each of the data items represents a maximum value.

As shown in FIG. 5, the maximum value for the rate indicating data is 251, and therefore 8 bits are needed for the 8-bit PSD 25.

Errors which may be generated in a rate indicating operation will now be explained.

There are two kinds of error, that is, one which may be generated during quantization as will be understood from the calculation example shown in FIG. 5, and the other which may be generated due to the fact that the oscillation of the rate indicating oscillator circuit 20 and the rise of each rate measuring pulse $P_H$ are asynchronous with respect to each other.

Figure 9:
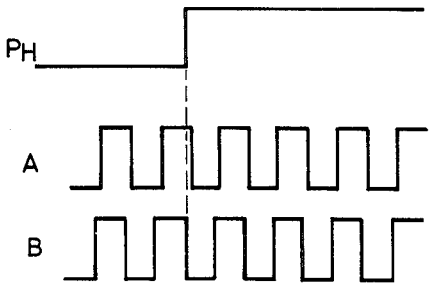
FIG. 9 shows the relationship between the rate measuring pulse and the output of the rate indicating oscillator circuit.

The quantization error is about 0.75 at maximum as shown in FIG. 5. The error, which is generated due to the fact that the fall of the oscillation waveform of the rate indicating oscillator circuit 20 and the rise of the rate measuring pulse $P_H$ are asynchronous with respect to each other, may be considered to be a value corresponding to one cycle of the oscillation of the rate indicating oscillator circuit 20, at maximum, as shown in FIG. 9.

When the rise of the rate measuring pulse $P_H$ and the fall of the output waveform of the rate indicating oscillator circuit 20 are synchronous with respect to each other as shown by the waveform B, it is assumed that the waveform B is in a state wherein the error is 0.

However, since the rate measuring pulse $P_H$ and the output of the rate indicating oscillator circuit 20 are asynchronous with respect to each other as shown by the waveform A, there is a possibility that an error may be generated which corresponds to one cycle of the oscillation output of the rate indicating oscillator circuit 20 at maximum.

Accordingly, there may be generated a total of errors which corresponds to about 1.75 cycles of the oscillation of the rate indicating oscillator circuit 20 at maximum.

This error is about 7 ms/d in terms of rate. Errors at this level can be ignored in practical use.

Figure 6:
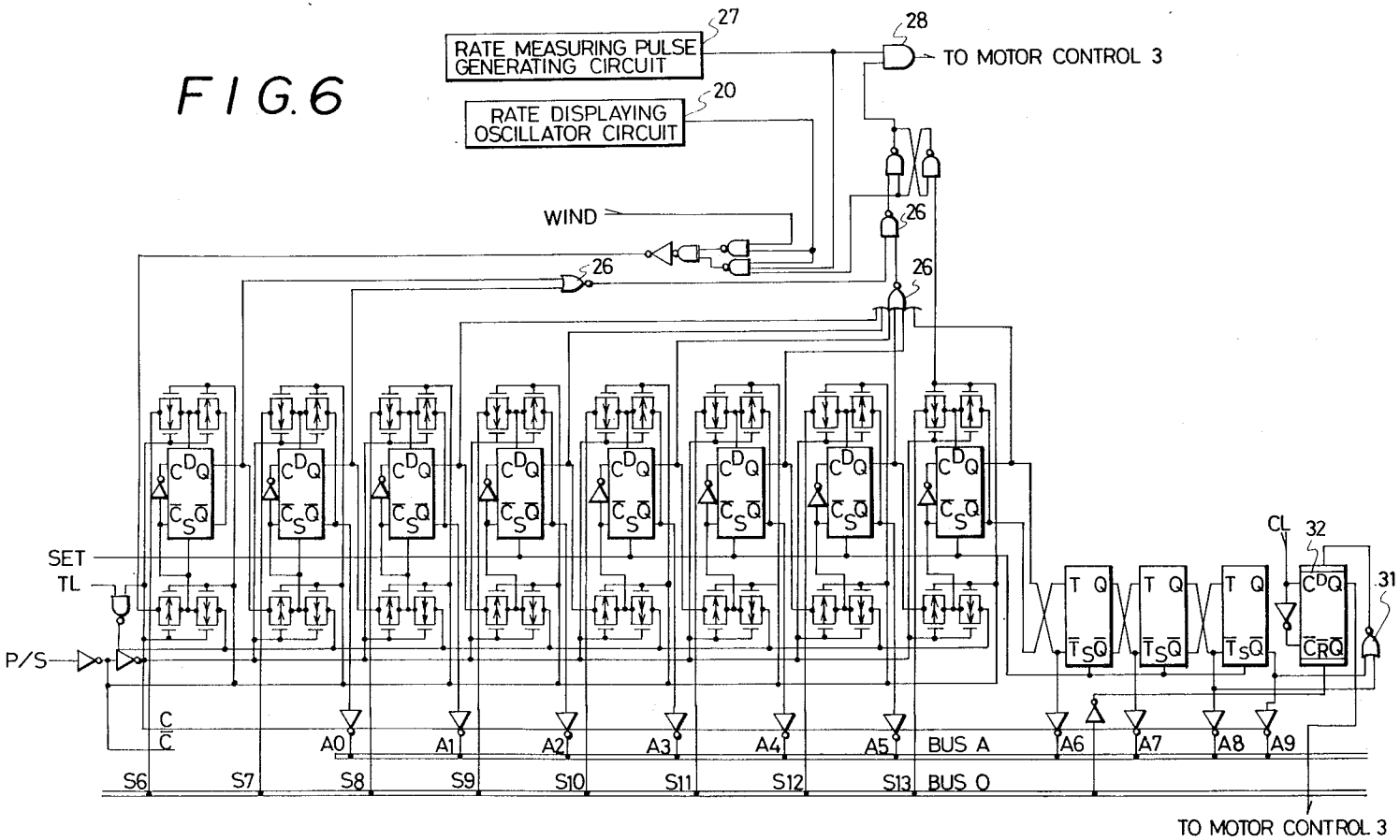
FIG. 6 shows an embodiment in which the frequency digitizing counter and the 8-bit presettable down counter are combined together.

FIG. 6 shows another embodiment in which the frequency digitizing counter and the 8-bit PSD are combined together.

The reference symbol P/S denotes a parallelserial switching signal, $T_L$ denotes a latch signal, SET denotes a set signal for setting a frequency digitizing counter to an initial value, WIND denotes pulses having a duration of 1/4096, and $C_L$ denotes a clock signal supplied to a latch circuit 32 from the control circuit.

The reference numerals in FIG. 6 respectively correspond to those shown in FIG. 1.

Figure 7:
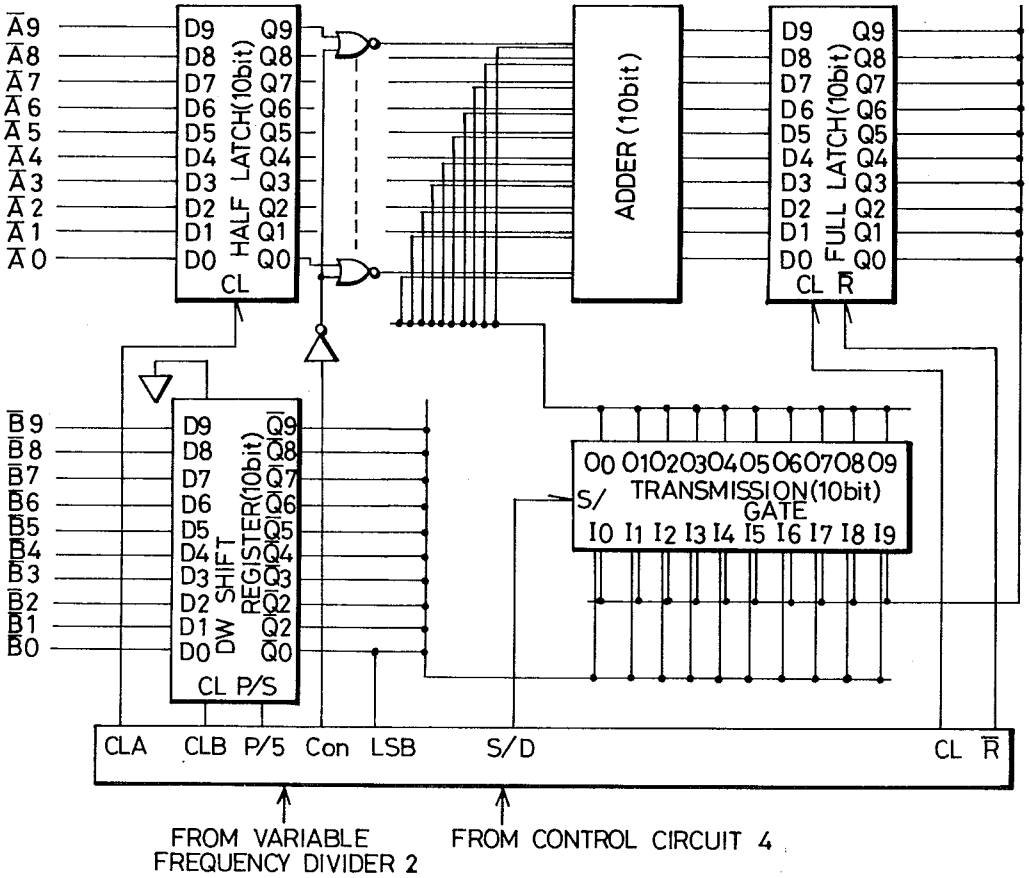
FIG. 7 is a block diagram illustrating the calculating circuit in detail.

FIG. 7 is a block diagram showing the calculating circuit 13 in detail. The calculating circuit 13 is of the general type which executes calculation from a low-order bit toward a high-order bit.

As has been described above, the present invention enables the average rate of a logical regulator to be measured with a conventional, commercially available measuring device even when the logical regulator is employed to perform a minute regulation which requires a high degree of precision.

Since a rate of a logical regulation which is carried out in a relatively long period cannot conventionally be indicated within a short time, it has heretofore been impossible to use a stable logical regulator for a minute regulation.

It is usual practice to adopt, as a means for replacing a logical regulator, a method wherein an oscillator circuit is directly controlled, for example, a method wherein the load capacity of an oscillator circuit is switched with time.

Such a conventional method causes oscillating conditions of the oscillator circuit to change by a large margin, which means that no stable operation can be expected.

In addition, the usual practice needs an adjusting operation for absorbing variations in, e.g., the load capacity.

In contrast, the present invention has no need of actuating the oscillator circuit and therefore enables it to be used in a stable state. Further, since the logical regulator operates digitally, it is unnecessary to conduct any adjusting operation, advantageously.

What is claimed is:

1. An electronic timepiece for effecting a first logical regulation function based on a first regulation period $T_1$ and a second logical regulation function based on a second regulation period $T_2$ longer than the first regulation period $T_1$, wherein the improvement comprises: a main oscillator circuit which generates a reference signal having an oscillation frequency for the timekeeping operation of the electronic timepiece; a rate indicating oscillator circuit whose oscillation frequency is $T_2/T_1$ or more times that of the oscillation frequency of the reference signal; means for digitizing the oscillation frequency of the rate indicating oscillator circuit; first calculating means for summing up regulation data items concerning the second logical regulation function during the first regulation period $T_1$; a register for holding the summed regulation data items; second calculating means for calculating rate indicating data from the summed regulation data items held in the register and numerical data concerning the oscillation frequency of the rate indicating oscillator circuit; a rate measuring pulse generating circuit for generating rate measuring pulses at the first regulation period; and a rate measuring pulse modulating circuit which modulates the time interval of the rate measuring pulses on the basis of the rate indicating data.

2. An electronic timepiece according to claim 1; wherein the output of the rate measuring pulses is inhibited by detecting the fact that the oscillation frequency of the rate indicating oscillator circuit is $T_2/T_1$ or less times that of the oscillation frequency of the main oscillator circuit which generates the reference signal for timekeeping operation.

3. An electronic timepiece comprising: oscillator means for producing a reference signal having a reference frequency dependent on ambient temperature to effect a timekeeping operation at a rate which fluctuates according to ambient temperature; means responsive to the ambient temperature for producing regulation data representative of a regulation amount of the timekeeping operation rate measured in terms of a given period $T_1$, the regulation data being composed of a coarse data component representative of a coarse regulation amount and a fine data component representative of a fine regulation amount; pulse generating means for producing at the given period $T_1$ a rating pulse having a pulse duration determined according to the regulation data to effect rate regulation of the timekeeping operation; first calculating means for accumulating fine data components during an extended period $T_2$ longer than the given period $T_1$ to calculate summed fine data components representative of a fine regulation amount of the timekeeping operation rate determined in terms of the extended period $T_2$; register means for holding the summed fine data components; second calculating means for calculating an average fine data component representative of an average fine regulation amount in terms of the given period $T_1$ based on the summed fine data components; and modulating means for modulating the pulse duration of the rating pulse according to the average fine data component.

4. An electronic timepiece according to claim 3; including means for effecting the rate regulation of the timekeeping operation according to a course data component at each of the given periods.

5. An electronic timepiece according to claim 3; including additional oscillator means for producing a control signal having a variable frequency not less than $T_2/T_1$ times that of the reference frequency; digitizing means for digitizing the variable frequency to produce numerical data representative of a number of pulses of the control signal within the given period $T_1$; and means for determining the modulation amount of the rating pulse duration in terms of a number of control signal pulses to effect the rating pulse modulation.

6. An electronic timepiece according to claim 5; including means for inhibiting the production of the rating pulse when the variable frequency of the control signal falls below $T_2/T_1$ times that of the reference frequency.

* * * * *